US011752442B2

(12) United States Patent
Dragusin

(10) Patent No.: US 11,752,442 B2
(45) Date of Patent: Sep. 12, 2023

(54) COMBINATION WOOD AND DIECAST MODEL VEHICLE

(71) Applicant: Candylab Toys Inc., New York, NY (US)

(72) Inventor: Vlad Dragusin, Brooklyn, NY (US)

( * ) Notice: Subject to any disclaimer, the term of this patent is extended or adjusted under 35 U.S.C. 154(b) by 0 days.

(21) Appl. No.: 17/077,839

(22) Filed: Oct. 22, 2020

(65) Prior Publication Data

US 2021/0129036 A1 May 6, 2021

Related U.S. Application Data

(60) Provisional application No. 62/929,331, filed on Nov. 1, 2019.

(51) Int. Cl.
*A63H 17/26* (2006.01)
*A63H 17/00* (2006.01)

(52) U.S. Cl.
CPC ..... *A63H 17/262* (2013.01); *A63H 17/002* (2013.01); *A63H 17/264* (2013.01)

(58) Field of Classification Search
CPC .. A63H 17/262; A63H 17/264; A63H 17/002; A63H 19/18
See application file for complete search history.

(56) References Cited

U.S. PATENT DOCUMENTS 2,332,718 A * 10/1943 Hickling ..... A63H 19/18 446/123
2,382,982 A * 8/1945 Elliott ..... A63H 33/108 D21/552
2,587,142 A * 2/1952 Gray ..... A63H 17/002 446/94
2,607,157 A * 8/1952 Smith ..... A63H 19/18 213/75 D
2,645,878 A * 7/1953 Johnson ..... A63H 19/18 446/137
3,009,287 A * 11/1961 Davis ..... A63H 17/262 446/466
3,611,618 A * 10/1971 Steiner ..... A63H 17/002 446/95

(Continued)

FOREIGN PATENT DOCUMENTS

GB 2391822 A * 2/2004 ..... A63H 19/14

*Primary Examiner* — Eugene L Kim
*Assistant Examiner* — Alyssa M Hylinski
(74) *Attorney, Agent, or Firm* — Douglas J. Ryder; Ryder, Mazzeo & Konieczny LLC

(57) ABSTRACT

A model vehicle is a combination of a wooden body and a wheel assembly providing free rolling wheels to provide increased functionality, usability, durability and nostalgic quality design. The wheel assembly includes a molded body, metal wire axles traversing the molded body and wheels mounted to each end of the axles. The wheel assembly is mounted to an underside of the wood body. The molded body may include an opening to allow a screw to pass therethrough to secure the wheel assembly to the wood body. The molded body may include a protrusion to assist with alignment of the wheel assembly and wood body. The molded body may include a receptacle to house a magnet to enable connection to an additional model vehicle to be towed. The wood body may include a lower piece and an upper piece secured together.

20 Claims, 8 Drawing Sheets

(56) References Cited

U.S. PATENT DOCUMENTS 3,707,761 A * 1/1973 LaBranche ..... A63H 17/262 264/261
3,720,017 A * 3/1973 Ersilio ..... A63H 17/262 446/466
4,164,090 A * 8/1979 Fischer ..... A63H 17/002 446/95
4,466,215 A * 8/1984 Hanazato ..... A63H 33/003 446/469
4,940,442 A * 7/1990 Matsuda ..... A63H 17/264 446/457
4,993,985 A * 2/1991 Bass ..... A63H 33/26 446/133
5,120,254 A * 6/1992 Daniels ..... A63H 17/262 446/469
5,674,105 A * 10/1997 Hamlin ..... A63H 17/008 446/457
5,919,077 A * 7/1999 Gondcaille ..... A63H 17/262 446/469
6,071,173 A * 6/2000 Kelley ..... A63H 17/00 446/431
2001/0021619 A1* 9/2001 Forkman ..... A63H 17/264 446/129
2005/0142981 A1* 6/2005 Anderson ..... A63H 33/16 446/80
2005/0153627 A1* 7/2005 Wong ..... A63H 29/08 446/431
2007/0238390 A1* 10/2007 Kelderhouse ..... A63H 17/262 446/469
2008/0242189 A1* 10/2008 Han ..... G09B 1/16 446/95
2015/0367242 A1* 12/2015 Calello ..... A63H 17/002 446/465
2019/0160386 A1* 5/2019 Kwan ..... A63H 17/262

* cited by examiner

COMBINATION WOOD AND DIECAST MODEL VEHICLE

PRIORITY

This application claims priority to U.S. Provisional Application 62/929,331 entitled "Model Toy Vehicle Assembly" which was filed on Nov. 1, 2019 with Vlad Dragusin as inventor. Application 62/929,331 is herein incorporated by reference in its entirety.

BACKGROUND

Wooden toy or model vehicles have been popular toy items since at least the eighteenth century. While wooden toys in general may date back even further, the advent of machining, manufacturing, and metalworking during the nineteenth and early twentieth centuries saw the shift away from wood for toy and model vehicles, and led to most toy vehicles being comprised of metals and metal alloys such as tin, iron, and eventually, pressed steel. Diecast metal toy vehicles spread during the first half of the twentieth century as casting technology allowed the models to be ever more detailed and intricate, especially compared to earlier media such as carved wood or pressed tin. During the latter half of the twentieth century, plastic manufacturing surged. Today, diecast metal and plastic toy or model vehicles are widespread, both as playthings and collectibles.

Wooden toy or model vehicles continue to be manufactured and sold today. They have certain advantages over their diecast or plastic counterparts, such as long-term durability, quality minimalistic design, ease of manufacture without the need for tooling or expensive molds and casts, and environmental friendliness. Wooden toys also have a timeless and nostalgic quality that attracts many to them even today. On the other hand, however, wooden toys cannot emulate the usability and functionality of diecast or plastic toy vehicles, particularly when it comes to free-rolling wheels. The wooden toys may have a hole drilled therethrough that an axle traverses and has wheels mounted thereto. Alternatively, each wheel may be connected to its own axle that is mounted into a respective position on the toy.

Conversely, diecast or plastic toy vehicles are able to contain much more exquisite details and have more functional elements over wooden vehicles, like flawlessly spinning wheels and opening doors. Diecast metal also adds a heft to the toy vehicle that makes it feel more substantial in the hand or during play. However, to their disadvantages, diecast metals deteriorate, and plastic has negative consequences on the environment.

What is needed is a toy vehicle that combines wooden and diecast materials to create a model or toy vehicle that provides the increased functionality, usability, and substance of a diecast metal toy vehicle, along with the durability, and minimalistic and nostalgic quality design of wooden vehicles.

BRIEF DESCRIPTION OF DRAWINGS

The features and advantages of the various embodiments will become apparent from the following detailed description in which.

DESCRIPTION

A model vehicle that is a combination of a wooden body and a wheel assembly providing free rolling wheels (combination vehicle) and method of assembly of the same are disclosed herein. The combination vehicle described herein provides increased functionality, usability, and substance along with durability, and minimalistic and nostalgic quality design.

Figure 1A:
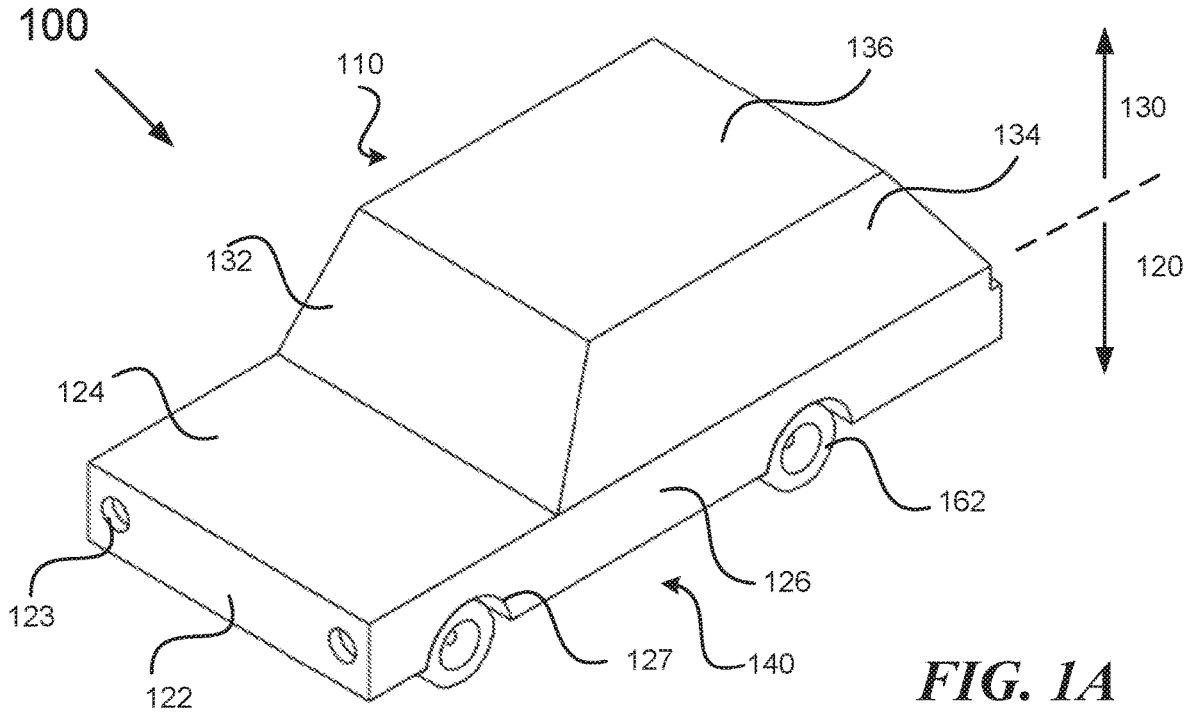
FIGS. 1-B illustrate perspective front and back views of an example combination vehicle, according to one embodiment.
Figure 1B:
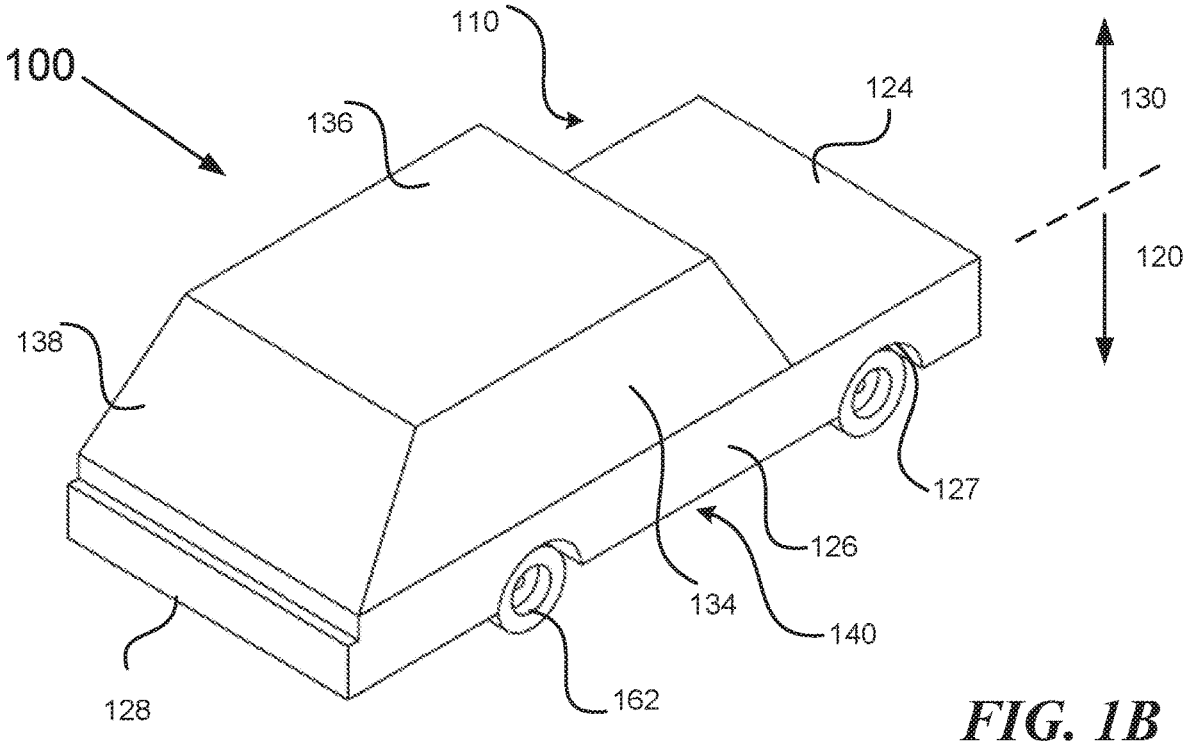

FIGS. 1-B illustrate perspective front and back views of an example combination vehicle 100. The combination vehicle 100 includes a wood body 110 and a wheel assembly 140 mounted to an underside of the wood body 110. The wood body 110 includes various parts of a body of the vehicle such as a front grill 122, a hood 124, side panels 126, a rear bumper 128, a front window 132, side windows 134, a roof 136 and a back window 138. The front grill 122 may have headlights 123 formed therein (only one identified for ease) and the side panels 126 may have wheel wells 127 formed therein (only one identified for ease). The wheel assembly 140 includes various components that will be described in more detail in the following figures as only wheels 162 are visible in FIGS. 1A-B.

The wood body 110 is in no way intended to be limited to the illustrated example. For example, as illustrated, the side windows 134 and the back window 138 extend substantially to the back bumper 128 but can end well before the back bumper 128 so that a trunk (not illustrated) would be included. Furthermore, the size, shape and orientation of the different parts may vary without departing from the current scope. The size, shape and orientation of the different parts may be selected to emulate classic vehicle designs or original vehicle designs. Moreover, parts may be removed (e.g., headlights) or added (e.g., roof rack) without departing from the current scope. The wood body 110 is illustrated as a car but is in no way intended to be limited thereto, rather it could be any type of vehicle including different types trucks, vans and jeeps without departing from the current scope.

The wood body 110 may preferably be two pieces of wood that are connected together. For example, the wood body 110 may include a lower piece 120 that includes the various parts of the vehicle associated with a body such as the front grill 122, the hood 124, the side panels 126, and the rear bumper 128 and an upper piece 130 that includes the various parts of the vehicle associated with a cabin such as the front window 132, the side windows 134, the roof 136 and the back window 138. The upper (cabin) and lower (body) pieces 130, 120 would be secured together in some fashion as will be described in more detail later. The use of upper (cabin) and lower (body) pieces 130, 120 provides ease in manufacturing as the pieces can be, for example, painted separately which reduces amount of masking required. The wood body 110 is not limited to being formed as a body 120 and a cabin 130 that are secured together. Rather, the wood body 110 could be made from a single piece of wood.

Figure 2:
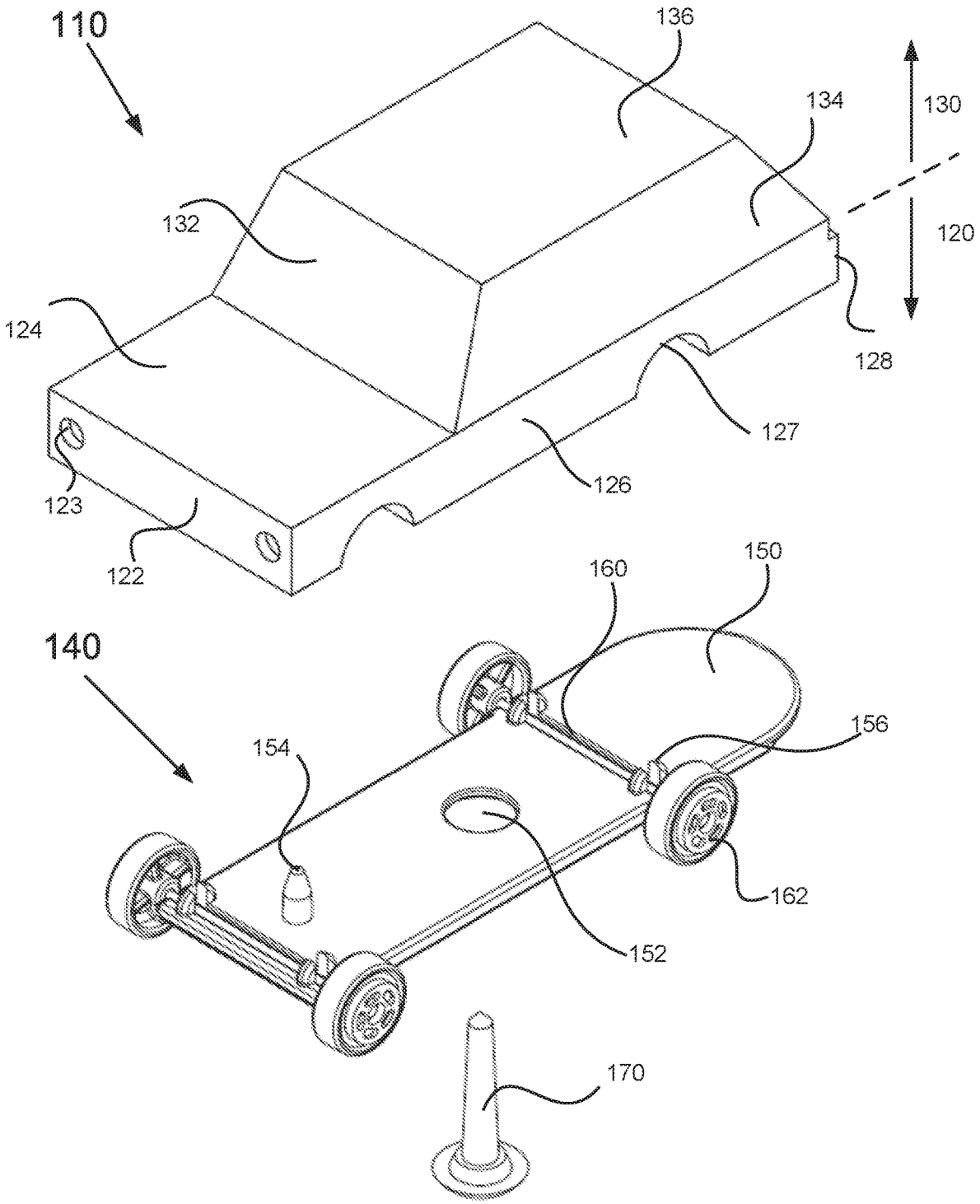
FIG. 2 illustrates an exploded view of an example combination vehicle, according to one embodiment.

FIG. 2 illustrates an exploded view of an example combination vehicle 100. The combination vehicle 100 includes the wood body 110 and the wheel assembly 140. The wood body 110 may include the various items described above with respect to FIGS. 1A-B and may be made of one piece of wood or multiple (e.g., two) pieces of wood that are secured together. The wheel assembly 140 may include a molded body 150, transversal axles 160 (two illustrated but only one labeled for ease of illustration) and wheels 162 (four illustrated but only one labeled for ease of illustration) mounted to each end of the axles 160. The molded body 150 may include an opening 152, a protrusion 154 and connectors 156 (four illustrated but only one labeled for ease of illustration) formed therein.

The opening 152 in the body 150 is to allow a screw 170 to pass therethrough to secure the wheel assembly 140 to the wood body 110. According to one embodiment, an underside of the wood body 110 may include a cavity (not illustrated in FIG. 2) for receiving the screw 170. The opening 152 is illustrated in the center of the body 150 but is not limited thereto. Furthermore, only a single opening 152 is illustrated but is not limited thereto. Rather, number, location, configuration, orientation and arrangement of the opening 152 could vary without departing the current scope.

The use of the screw 170 is preferrable as it provides a secure connection between the wheel assembly 140 and the wood body 110 that could be removed so that the wheel assembly 140 and the wood body 110 could be disengaged if desired and/or required. While a screw 170 may be preferrable it is not limited thereto. Rather, various connection devices (e.g., nail, rivet, bolt, clip, peg) could be utilized without departing from the current scope. The use of the screw 170 (or other connection devices) to connect the upper and lower pieces 130, 120 enables various upper and lower pieces 130, 120 to be combined to make different overall wood bodies 110.

While the use of the screw 170 (or other connection devices) to connect the wheel assembly 140 and the wood body 110 may be preferrable for various reasons (including assembly), it is not limited thereto. Rather the wheel assembly 140 and the wood body 110 could be connected via any number of temporary (e.g., Velco®) or permanent (e.g., glue) manners without departing from the current scope.

The protrusion 154 may be configured to be received by the underside of the wood body 110 to assist in alignment of the wheel assembly 140 and the wood body 110. According to one embodiment, an underside of the wood body 110 may include a cavity (not illustrated in FIG. 2) for receiving the protrusion 154. The protrusion 154 is illustrated toward a front of the body 150 but is not limited thereto. Furthermore, only a single protrusion 154 is illustrated but is not limited thereto. Rather, number, location, configuration, orientation and arrangement of the protrusion 154 could vary without departing the current scope.

The use of the protrusion 154 may be preferrable as it provides a simple way for aligning the wheel assembly 140 and the wood body 110. However, alignment of the wheel assembly 140 and the wood body 110 is not limited to the protrusion 154. Rather, various manners for providing alignment would be within the current scope. For example, the body 150 of the wheel assembly 140 could be as wide as the underside of the wood body 110 and include tabs extending upwards on outer edges thereof that would rest against sides of the wood body 110. The wood body 110 could have protrusions extending from an underside thereof that could be received within recesses or holes in the body 150 of the wheel assembly 140.

The connectors 156 are located in front and back near each side edges of the body 150 and are configured to receive and secure an end of each transversal axle 160. According to one embodiment, after the axle 160 is received within the connector 156, ends of the connector 156 may be crimped together to fully secure the axle 160 therein. The crimping of the connectors 156 may also assist in having the wheel assembly 140 (body 150) lay flush against the wood body 110. According to one embodiment, an underside of the wood body 110 may include indents (not illustrated) for receiving the connectors 156. The indents may help secure the axles 160 therein and/or may help the wheel assembly 140 lay flush against the wood body 110.

The connectors 156 are illustrated as a tab on each side of the axle 160 that are spaced apart approximately a diameter of the axle 160 apart but are no way intended to be limited thereto. Rather, other connectors could be utilized without departing from the current scope. The connectors 160 are illustrated along each side edge but are not limited thereto. Rather, additional connectors 156 may be included, for example in the middle of the body 150, or a single long connector may be utilized along a majority of the axles 160 without departing the current scope.

While not clearly visible in FIG. 2, the body 150 may include grooves formed therein traversing from side to side for receiving the axles 160. The grooves may be rounded to allow the axles 160 to spin freely therewithin. The groves may be deep enough to enable at least a portion of the axles 160 to be below an upper surface of the body 150. The grooves may assist in the wheel assembly 140 laying flush against the wood body 110.

The body 150 may be sized to mirror an underside of the wood body 110 in length and width. Alternatively, the body 150 may be smaller than the underside of the wood body 110 in length and/or width.

The molded body 150 of the wheel assembly 140 may be fabricated (e.g., die cast) from metal, such as zinc, or metal alloys, such as zinc alloy. Alternatively, the molded body 150 may be fabricated (e.g., injection molded) from plastics or composites.

The transversal axles 160 extend across length of the body such that the wheels 162 mounted to each side thereof are external to the body 150. The axles 160 are illustrated as being located along a front edge of the body 150 and towards back thereof (the body 150 extends past the back axle 160). The location of the axles 160 along the body 150 are not limited thereto. Rather, the body 150 could extend past both the front and back axles 160 (same amount or different amounts), only past the front axle 160, or past neither, without departing from the current scope. The location of the axles 160 is simply limited by the location of the wheel wells 127 so that the wheels 162 align with the wheel wells 127.

The axles 160 may be made from a steel wire to enable them to better spin freely. Alternatively, the axles 160 may be made from a metal wire, such as zinc or other metal alloy. The wheels 162 may be made from plastic or alternatively rubber. The wheels 162 may be molded (e.g., injection molded).

Figure 3:
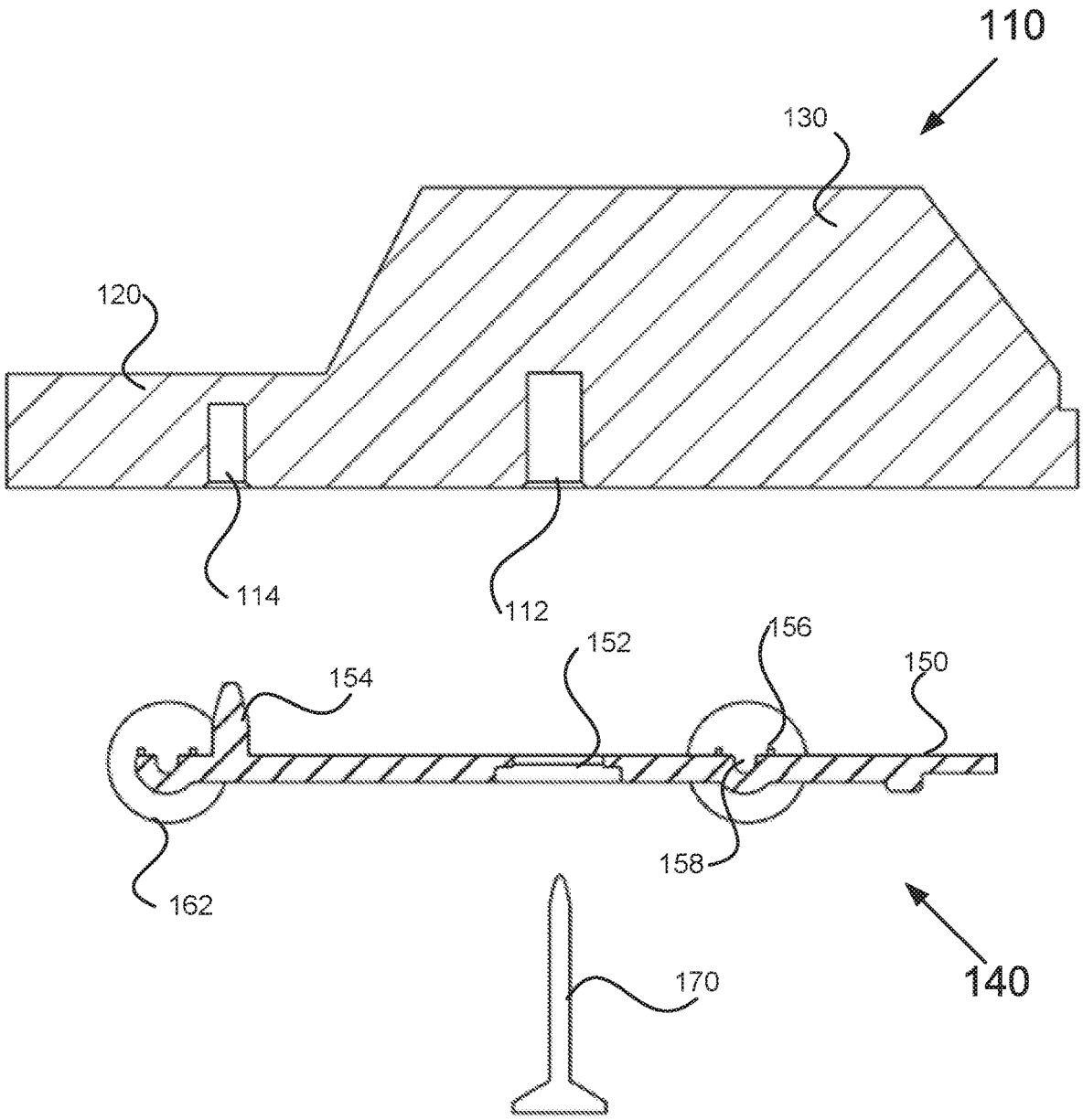
FIG. 3 illustrates a cross sectional view of an example combination vehicle, according to one embodiment.

FIG. 3 illustrates a cross sectional view of an example combination vehicle 100. The combination vehicle 100 includes the wood body 110 and the wheel assembly 140. The wood body 110 is identified as having upper and lower pieces 130, 120 but is not limited thereto.

An underside of the wood body 110 may include a cavity 112 in alignment with the opening 152 for receiving the screw 170 (or other connection device) to secure the wheel assembly 140 and the body 110 together. Preferably, the cavity 112 may be formed all the way through the lower piece 120 and into the upper piece 130 and the screw 170 may pass through the lower piece 120 and into the upper piece 130 in order to not only secure the wheel assembly 140 to the wood body 110 but also secure the upper and lower pieces 130, 120 together. In order to align the upper and lower pieces 130, 120 they may include aligned holes (not illustrated) therein. The aligned holes may receive a dowel therewithin to align the upper and lower pieces 130, 120. Other means of alignment may be within the current scope.

While the screw 170 and the cavity 112 formed throw the lower piece 120 and into the upper piece 130 may be preferable to secure the entire combined vehicle 100 together, it is not limited thereto. Rather, the screw 170 may simply be used to connect the wheel assembly 140 to the lower piece 120 (the cavity may simply be located in lower piece 120) and the upper and lower pieces 130, 120 may be connected via any number of temporary (e.g., Velco®) or permanent (e.g., glue) manners. Alternatively, the wood body 110 may be a single piece of wood.

The underside of the wood body 110 may also include a cavity 114 in alignment with the protrusion 154 to assist in aligning the wheel assembly 140 and the body 110. The cavity 114 may be formed in the lower piece 120 and may extend a desired distance thereinto.

Grooves 158 (two illustrated but only one labeled for ease of illustration) are formed in the body 150 at locations where the axles (not visible) are to be received. The grooves 158 are rounded so as to enable the axles to spin freely therewithin and may be deep enough to enable at least a portion of the axles to be below an upper surface of the body 150. The connectors 156 (two illustrated but only one labeled for ease of illustration) extend upward from the body 150. The connectors 156 include a tab on each side of the grooves 158 to secure the axles therewithin.

Figure 4A:
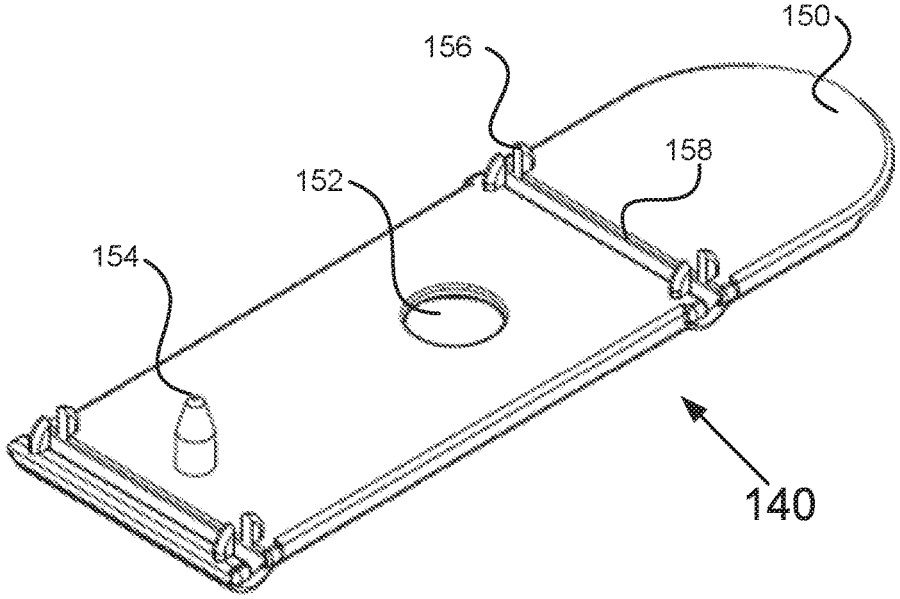
FIGS. 4A-B illustrate perspective views of an example wheel assembly before and after axles and wheels are mounted thereto, according to one embodiment.
Figure 4B:
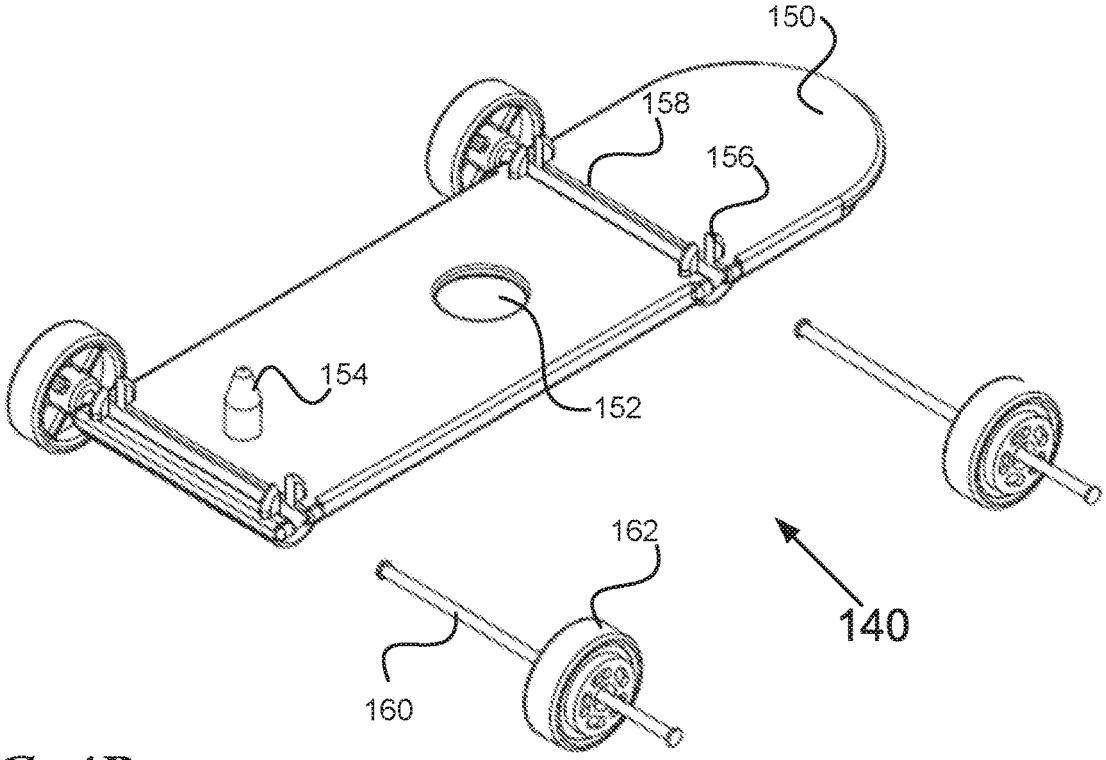

FIGS. 4A-B illustrate perspective views of an example wheel assembly 140 before and after the axles 160 and the wheels 162 are mounted to the body 150. The body 150 includes the opening 152, the protrusion 154, the connectors 156 (four illustrated but only one labeled for ease of illustration) and the grooves 158 (two illustrated but only one labeled for ease of illustration). The grooves 158 traverse from side to side of the body 150 and the axles 160 are located therewithin and are secured in place by the connectors 156. The axles 160 extend passed the sides of the body 150 and the wheels 162 are mounted thereto and external to the body 150. The wheels 162 extend above and below the body 150.

According to one embodiment, the combined vehicle 100 may include an item (e.g., roof rack, sign, surf board, canoe, skis, bike, luggage) mounted to the roof 134. The item may be a separate component that is mounted to the roof 134 and may be made of wood or may be made of some other material. The item may be secured to the roof 134 in a permanent fashion (e.g., glue) or a removable fashion (e.g., Velcro®, connectors). The item may be aligned and secured to the roof 134 utilizing one or more aligned sets holes and a corresponding dowel.

The item is not limited to being a sperate piece. Rather the item could be made from same piece of wood as the upper piece (cabin) 130 or from same piece as overall wood body 110 if the wood body 110 was made from a single piece.

Figure 5:
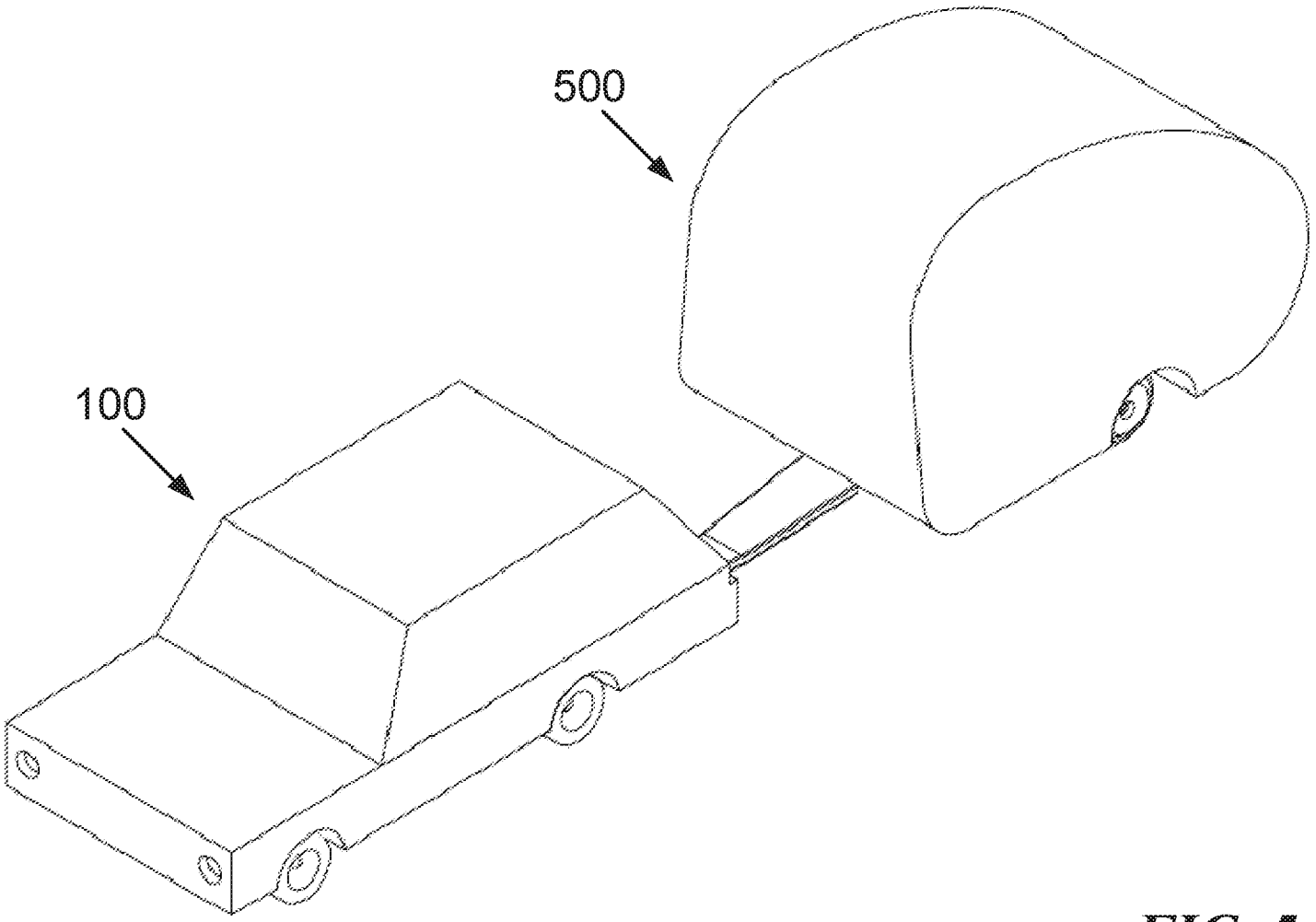
FIG. 5 illustrates a perspective view of a combined vehicle (e.g., car) towing another combined vehicle (e.g., trailer), according to one embodiment.

It may be desirable for a combined vehicle (e.g., car) to be able to tow another combined vehicles (e.g., trailer). In order to accommodate towing, a means for securing the vehicles is required. FIG. 5 illustrates a perspective view of a combined vehicle 100 (e.g., car) towing another combined vehicle 500 (e.g., trailer). The combined vehicle 500 may include a hitch that extends from a front thereof and is secured to the vehicle 100.

Figure 6A:
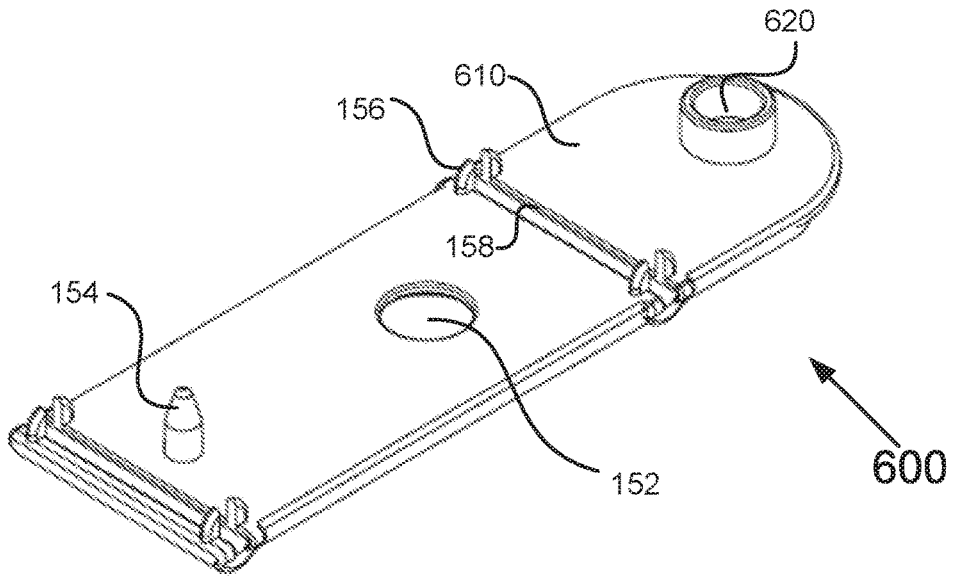
FIGS. 6A-B illustrate perspective views of an example wheel assembly utilized in a combined vehicle (e.g., car) for towing, according to one embodiment.
Figure 6B:
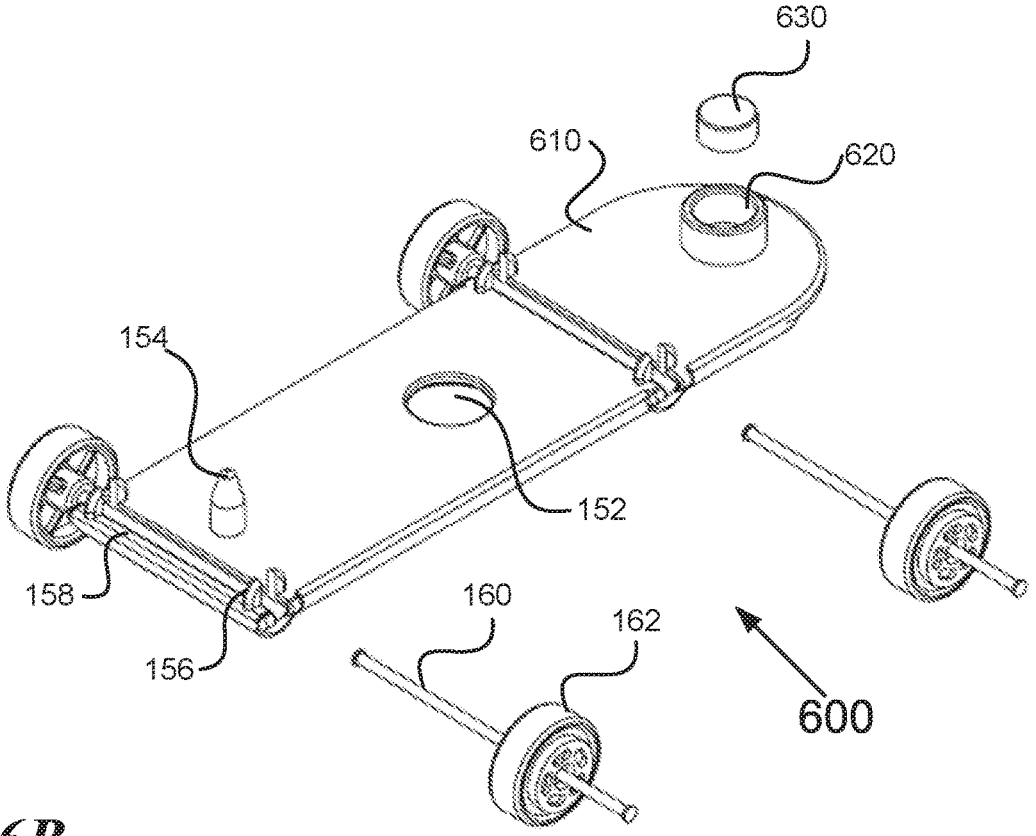

FIGS. 6A-B illustrate perspective views of an example wheel assembly 600 utilized in a combined vehicle 100 (e.g., car) for towing. FIG. 6A illustrates the example wheel assembly 600 before the axles 160 and the wheels 162 are mounted thereto and FIG. 6B illustrates the example wheel assembly 600 after the axles 160 and the wheels 162 are mounted thereto. The wheel assembly 600 is similar to the wheel assembly 140 and includes additional components to enable towing to occur. The wheel assembly 600 includes a body 610 having an opening 152, a protrusion 154, connectors 156 (four illustrated but only one labeled for ease of illustration) and grooves 158 (two illustrated but only one labeled for ease of illustration). In addition, the body 610 includes a receptacle 620 for receiving a magnet 630. The magnet 630 is utilized to secure the hitch thereto. An underside of the wood body 110 may include a cavity to receive the receptacle 620 and the magnet 630 so that the wheel assembly 600 (body 610) lays flush against the wood body 110.

Figure 7:
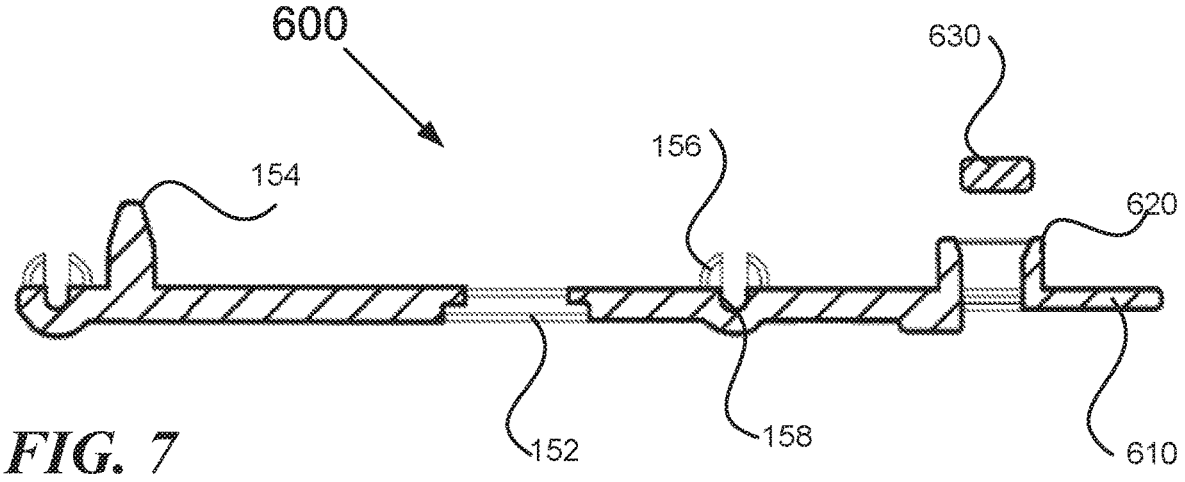
FIG. 7 illustrates a cross sectional view of an example molded body of a wheel assembly utilized for towing absent the axles and wheels, according to one embodiment.

FIG. 7 illustrates a cross sectional view of an example body 610 of a wheel assembly 600 utilized for towing in a combined vehicle 100 (e.g., car). The body 610 includes the opening 152, the protrusion 154, the connectors 156 (two illustrated but only one labeled for ease of illustration), the grooves 158 (two illustrated but only one labeled for ease of illustration) an the receptacle 620 for receiving the magnet 630.

Figure 8:
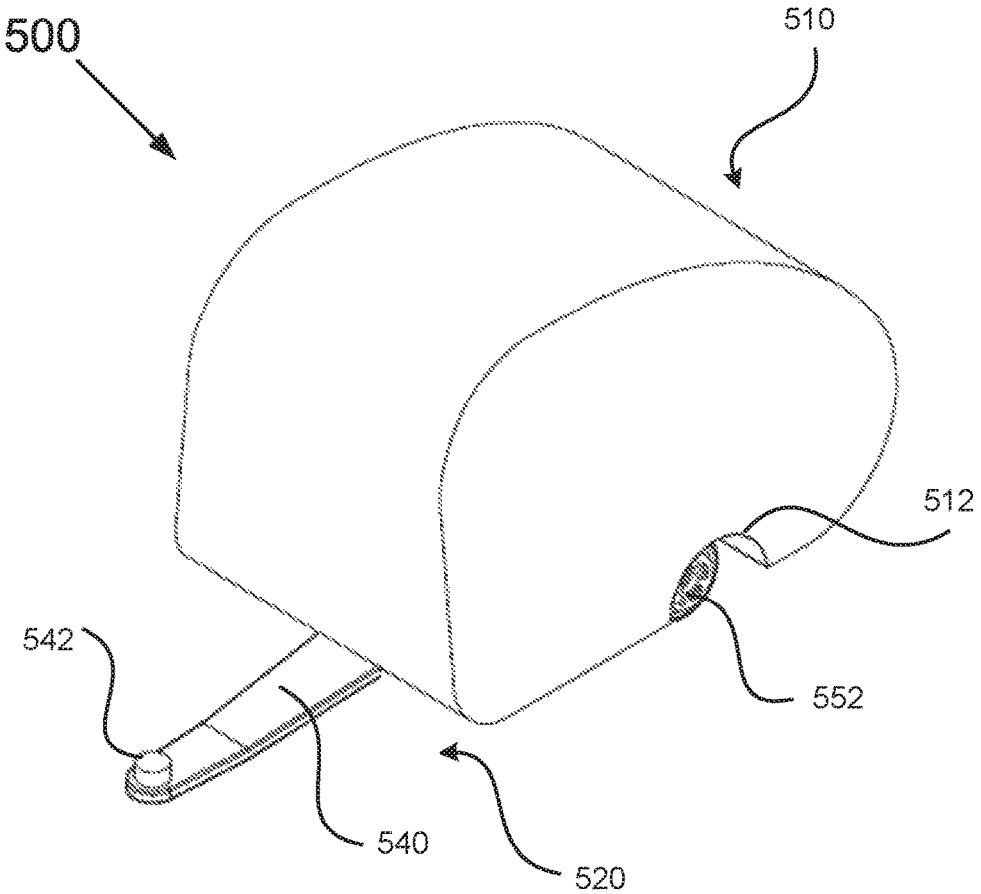
FIG. 8 illustrates a perspective view of an example combined vehicle that is to be towed, according to one embodiment.

FIG. 8 illustrates a perspective view of an example combined vehicle 500 that is to be towed. The combined vehicle 500 includes a wood body 510 and a wheel assembly 520 mounted to an underside thereof. The wood body 510 may be sized, shaped and orientated as desired to look like whatever type of vehicle is being towed. The wood body 510 made include wheel wells 512 formed on sides thereof. The wheel assembly 520 includes various components that will be described in more detail in the following figures as only a wheel 552, a hitch 540 and a ferrous nub 542 are visible.

Figure 9A:
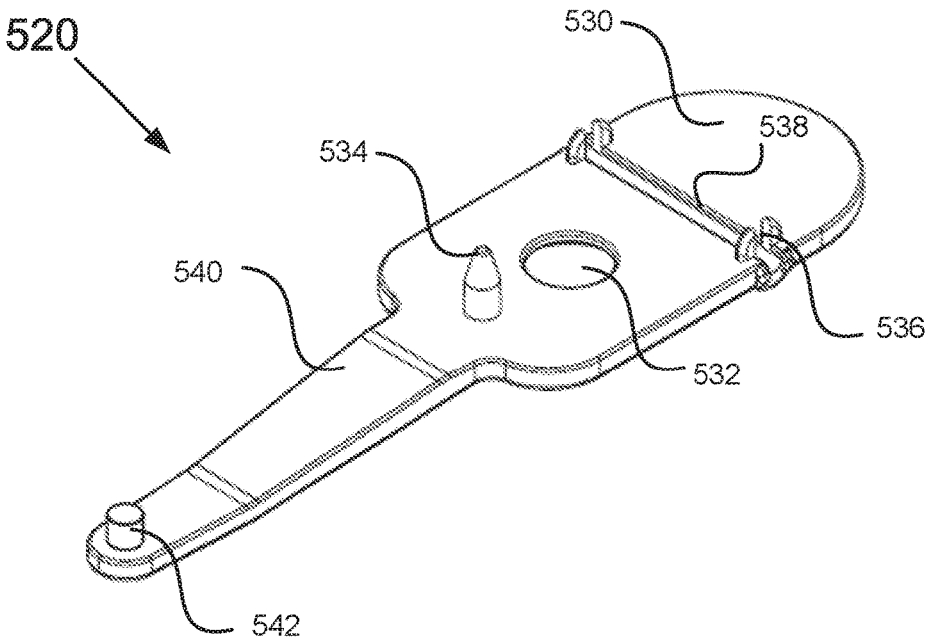
FIGS. 9A-B illustrate perspective views of an example wheel assembly of a vehicle to be towed, according to one embodiment.
Figure 9B:
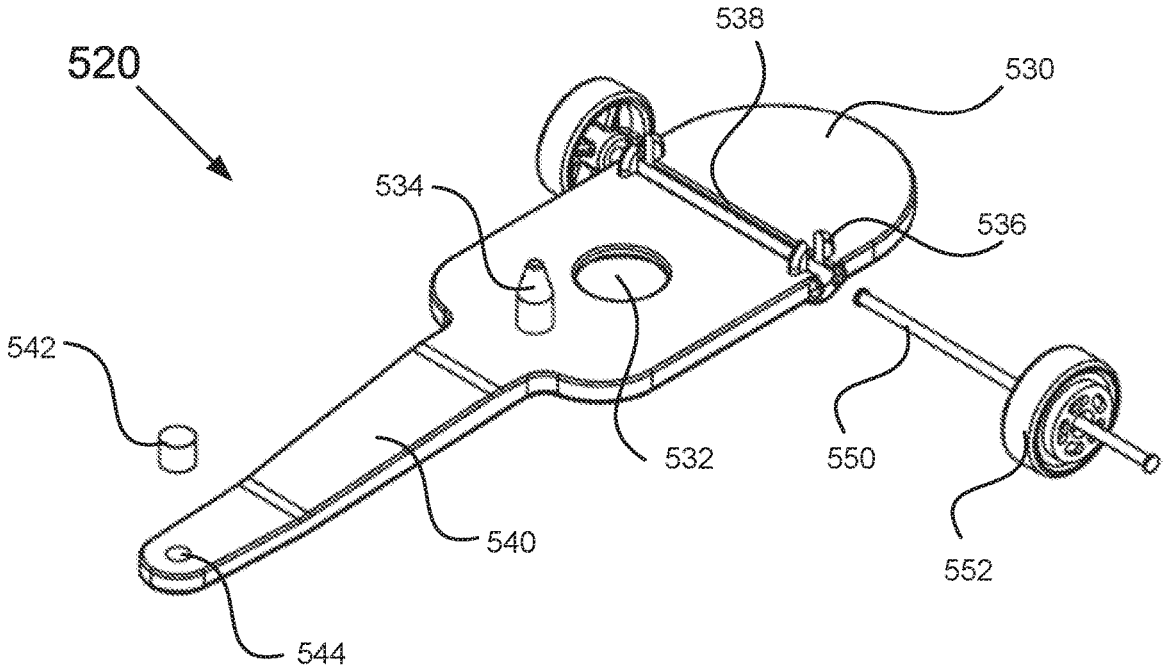

FIGS. 9A-B illustrate perspective views of an example wheel assembly 520 of a vehicle to be towed. The wheel assembly 520 may include a molded body, an axle 550 and wheels 552 (two illustrated but only one labeled for ease of illustration). The molded body may include a main body 530 and a hitch 540 extending from the main body 530. The main body 530 may include an opening 532, a protrusion 534, connectors 536 (two illustrated but only one labeled for ease of illustration) and a groove 538 formed therein.

The opening 532 is to allow a connection device (not illustrated) to pass therethrough in order to secure the wheel assembly 520 to the wood body 510. According to one embodiment, an underside of the wood body 510 may include an aligned cavity for receiving the connection device. The number, location, configuration, orientation and arrangement of the opening 532 could vary without departing the current scope.

The protrusion 534 may be configured to be received by the underside of the wood body 510 to assist in alignment of the wheel assembly 520 and the wood body 510. According to one embodiment, an underside of the wood body 510 may include a cavity for receiving the protrusion 534. The number, location, configuration, orientation and arrangement of the protrusion 534 could vary without departing the current scope.

The connectors 536 are configured to receive and secure the axle 550. According to one embodiment, after the axle 550 is received within the connector 536, ends of the connector 536 may be crimped together to fully secure the axle 550 therein. According to one embodiment, an underside of the wood body 510 may include indents for receiving the connectors 536. The connectors 536 are illustrated as a tab on each side of the axle 550 that are spaced apart approximately a diameter of the axle 550 but are no way intended to be limited thereto. The groove 538 may be rounded so as to receive the axle 550 and enable the axle 550 to spin freely therewithin.

The hitch 540 may extend out from under the wood body 510 to enable the combined vehicle 500 to be secured to the combined vehicle 100. The hitch 540 may include a hole 544 formed therein that enables the ferrous nub 542 may be secured thereto, with for example a screw, rivet or the like (not illustrated). The ferrous nub 542 may be utilized to secure the hitch 540 and thus the vehicle 500 to the vehicle 100 via the attraction of the ferrous nub 542 to the magnet 630.

The connection of the vehicle 100 and the vehicle 500 is not limited to the use of the magnet 630 on the vehicle 100 and the ferrous nub 542 on the vehicle 500. For example, the magnet 630 could be located on the vehicle 500 and the ferrous nub 542 could located on be the vehicle 100. Alternatively, each of the vehicles 100/500 could include a magnet where the magnets are configured such that opposite poles face each other.

The combined vehicle 500 (wheel assembly 520) is illustrated as including only a single axle 550 but in no way is intended to be limited thereto. Rather, the number of axles 550 would be based on the combined vehicle 500 that is being towed. For example, if the combined vehicle 500 was a horse trailer or a camper, additional axles 550 may be included. The design and size of the wood body 510 will dictate the size and configuration (e.g., number and location of axles 550, location of opening 532, location of the protrusion 534) of the wheel assembly 520.

The vehicles 100/500 illustrated have a single wheel 162, 552 mounted on each side of the transversal wire axle 160, 550 but are not limited thereto. According to one embodiment, one or more of the axles 160, 550 may have more than one wheel 162, 552 mounted on each side thereof. For example, if the vehicle 100 was a pick-up truck the back axle 160 may have two wheels 162 on each side where an outer wheel 162 may extend outside of the wheel well 127.

Although the invention has been illustrated by reference to specific embodiments, it will be apparent that the invention is not limited thereto as various changes and modifications may be made thereto without departing from the scope. Reference to "one embodiment" or "an embodiment" means that a particular feature, structure, or characteristic described therein is included in at least one embodiment. Thus, the appearances of the phrase "in one embodiment" or "in an embodiment" appearing in various places throughout the specification are not necessarily all referring to the same embodiment.

The various embodiments are intended to be protected broadly within the spirit and scope of the appended claims.

What is claimed is:

1. A model vehicle comprising:

a vehicle body formed from wood to provide an exterior design and have a solid interior, wherein the vehicle body includes a flat underside, wherein the flat underside includes an entry to a cavity formed in the vehicle body for receiving a connection device;

a wheel assembly connected to the flat underside of the vehicle body, wherein the wheel assembly includes a molded body, a metal wire axle, and a pair of wheels, wherein the molded body includes an upper surface that lays flush against the flat underside of the vehicle body when the wheel assembly is connected thereto, the molded body includes an opening in alignment with the cavity, wherein the opening is to allow a portion of the connection device to pass therethrough and enter the cavity, the molded body is configured to secure the metal wire axle to the upper surface thereof, the metal wire axle traverses across the upper surface of the molded body and extends past sides thereof, the metal wire axle includes a wheel from the pair of wheels mounted to each end thereof such that the wheels are located past the sides of the molded body, and the metal wire axle and the mounted pair of wheels are free to rotate, and the connection device to secure the wheel assembly and the vehicle body together.

2. The model vehicle of claim 1, wherein the molded body is die cast from a metal alloy.

3. The model vehicle of claim 1, wherein the molded body is injection molded from plastic.

4. The model vehicle of claim 1, wherein the connection device is a screw.

5. The model vehicle of claim 1, wherein the molded body of the wheel assembly includes a protrusion extending upward from the upper surface toward the flat underside of the vehicle body;

the flat underside of the vehicle body includes a recess in alignment with the protrusion and capable of receiving the protrusion therein, wherein the protrusion and the recess are configured to assist in aligning the wheel assembly with the vehicle body.

6. The model vehicle of claim 1, wherein the vehicle body is formed from an upper piece of wood and a lower piece of wood secured to one another.

7. The model vehicle of claim 1, wherein the molded body of the wheel assembly includes a rounded groove formed in the upper surface traversing from side to side to receive the metal wire axle.

8. The model vehicle of claim 1, wherein the molded body of the wheel assembly includes connectors formed in the upper surface to secure the metal wire axle to the molded body.

9. The model vehicle of claim 1, wherein the molded body of the wheel assembly includes a receptacle to house a component to enable a magnetic connection to a hitch of an additional model vehicle to be towed.

10. The model vehicle of claim 9, wherein the component is a magnet.

11. The model vehicle of claim 1, wherein the molded body of the wheel assembly includes a hitch extending from a front end thereof that extends in front of the vehicle body when the wheel assembly is connected to the flat underside of the vehicle body, wherein the hitch includes a component to enable a magnetic connection to a back of an additional model vehicle to provide towing to the model vehicle.

12. The model vehicle of claim 11, wherein the component is a ferrous tip.

13. The model vehicle of claim 6, wherein the lower piece of wood includes an opening in alignment with the opening in the molded body, and the upper piece of wood includes a receptacle in alignment with the opening in the lower piece of wood, wherein the opening in the lower piece of wood and the receptacle in the upper piece of wood form the cavity.

14. A model vehicle comprising:

a vehicle body formed from an upper piece of wood and a lower piece of wood, wherein the vehicle body has an exterior design and a solid interior, wherein the lower piece of wood includes a flat underside, wherein the flat underside includes an entry to a cavity formed in the vehicle body for receiving a screw;

a wheel assembly connected to the flat underside, wherein the wheel assembly includes a molded body, at least one metal wire axle, and at least one pair of wheels, wherein the molded body includes an upper surface that lays flush against the flat underside of the vehicle body when the wheel assembly is connected thereto, the molded body includes an opening formed therein in alignment with the cavity, wherein the opening is to allow a portion of the screw to pass therethrough and enter the cavity, the molded body includes at least one rounded groove formed in the upper surface traversing from side to side and at least one connector associated with each of the at least one rounded groove formed in the upper surface, the at least one metal wire axle is placed in the at least rounded groove and is secured in place by the at least one connector and extends past sides thereof, the at least one metal wire axle includes a wheel from the at least one pair of wheels mounted to each end thereof such that the wheels are located past the sides of the molded body, and the metal wire axle and the mounted pair of wheels are free to rotate; and the screw to secure the wheel assembly and the vehicle body together.

15. The model vehicle of claim 14, wherein the molded body is die cast from a metal alloy.

16. The model vehicle of claim 14, wherein the molded body of the wheel assembly includes a protrusion extending from the upper surface; and the vehicle body includes a recess in the flat underside of the lower piece of wood, wherein the recess is in alignment with the protrusion in the molded body of the wheel assembly, wherein the protrusion and the recess assist in aligning the wheel assembly with the vehicle body.

17. The model vehicle of claim 14, wherein the molded body of the wheel assembly includes a receptacle to house a magnet; and the flat underside of the lower piece of wood of the vehicle body includes a cavity to receive the receptacle and the magnet when the wheel assembly is secured to the vehicle body, wherein the magnet is to enable a magnetic connection to a hitch of an additional model vehicle to be towed.

18. The model vehicle of claim 14, wherein the molded body of the wheel assembly includes a hitch extending from a front end thereof that extends in front of the vehicle body when the wheel assembly is connected to the flat underside of the vehicle body, wherein the hitch includes a component to enable a magnetic connection to a back of an additional model vehicle to provide towing to the model vehicle.

19. A model vehicle comprising:

a wheel assembly including a molded metal alloy body, at least one metal wire axle, at least one pair of wheels and a magnet, wherein the molded body includes an opening formed therein, the molded body include at least one rounded groove formed in an upper surface traversing from side to side and at least one connector associated with each of the at least one rounded groove formed in the upper surface, the at least one metal wire axle is placed in the at least rounded groove and is secured in place by the at least one connector and extends past sides thereof, the at least one metal wire axle includes a wheel from the at least one pair of wheels mounted to each end thereof such that the wheels are located past the sides of the molded body, the metal wire axle and the mounted pair of wheels are free to rotate, and the molded body includes a receptacle configured to house the magnet;

a vehicle body formed from a lower piece of wood and an upper piece of wood that together define an exterior vehicle design and have a solid interior, wherein the lower piece of wood includes a flat underside, the lower piece of wood includes a first cavity having an entry on the flat underside, wherein the cavity is configured to receive the receptacle of the molded body that is configured to house the magnet, the lower piece of wood includes an opening in alignment with the opening in the molded body, and the upper piece of wood includes a receptacle in alignment with the opening in the lower piece of wood, wherein the opening in the lower piece of wood and the receptacle in the upper piece of wood form a second cavity; and a screw to secure the wheel assembly and the lower piece of wood and the upper piece of wood of the vehicle body together, wherein a portion of the screw passes through the opening in the molded body and is received in the second cavity, and wherein the upper surface of the molded body of the wheel assembly lays flush against the flat underside of the lower piece of wood.

20. The model vehicle of claim 19, wherein the molded body of the wheel assembly includes a protrusion extending from the upper surface; and the lower piece of wood of the vehicle body includes a recess in the flat underside thereof in alignment with the protrusion in the molded body of the wheel assembly, wherein the protrusion and the recess assist in aligning the wheel assembly with the vehicle body.

* * * * *